US011664007B1

(12) United States Patent
Bastyr

(10) Patent No.: US 11,664,007 B1
(45) Date of Patent: May 30, 2023

(54) FAST ADAPTING HIGH FREQUENCY REMOTE MICROPHONE NOISE CANCELLATION

(71) Applicant: Harman International Industries, Incorporated, Stamford, CT (US)

(72) Inventor: Kevin J. Bastyr, Franklin, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 17/730,906

(22) Filed: Apr. 27, 2022

(51) Int. Cl.
*G10K 11/178* (2006.01)

(52) U.S. Cl.
CPC .. *G10K 11/17883* (2018.01); *G10K 11/17854* (2018.01); *G10K 2210/1282* (2013.01); *G10K 2210/3226* (2013.01)

(58) Field of Classification Search
None
See application file for complete search history.

(56) References Cited

U.S. PATENT DOCUMENTS

2016/0196817 A1* 7/2016 Mortensen ..... G10K 11/17823 381/71.8
2019/0051283 A1* 2/2019 Malka ..... G10K 11/178

* cited by examiner

*Primary Examiner* — Kenny H Truong
(74) *Attorney, Agent, or Firm* — Brooks Kushman P.C.

(57) ABSTRACT

In at least one embodiment, an active noise cancellation (ANC) system is provided. The ANC system includes at least one microphone, a first filter, a first controllable filter, and at least one controller. The at least one microphone provides an error signal indicative of noise and an anti-noise sound within the cabin. The first filter modifies a transfer function between the at least one microphone and at least one remote microphone location to generate an estimated remote microphone error signal based at least on the error signal. The first controllable filter generates the anti-noise signal based on the estimated remote microphone error signal. The controller receives receive a first signal indicative of the vehicle exhibiting a fast-adapting event controls the first filter to execute a predetermined filter based on the first signal to reduce a group delay associated with the first filter.

20 Claims, 5 Drawing Sheets

FAST ADAPTING HIGH FREQUENCY REMOTE MICROPHONE NOISE CANCELLATION

TECHNICAL FIELD

The present disclosure is generally directed to a system and method for noise cancellation. For example, the system and the method may provide for engine order cancellation (EOC) or road noise cancellation (RNC). More particularly, the system and the method for EOC or RNC may account for, but not limited to, dynamic skip fire engines, fast gear shifts and/or pavement transitions. These aspects and others will be discussed in more detail herein.

BACKGROUND

Active Noise Cancellation (ANC) systems attenuate undesired noise using feedforward and/or feedback structures to adaptively remove undesired noise within a listening environment, such as within a vehicle cabin. ANC systems generally cancel or reduce unwanted noise by generating cancellation sound waves to destructively interfere with the unwanted audible noise. Destructive interference results when noise and "anti-noise," which is largely identical in magnitude but opposite in phase to the noise, reduce the sound pressure level (SPL) at a location. In a vehicle cabin listening environment, potential sources of undesired noise come from the engine, the exhaust system, the interaction between the vehicle's tires and a road surface on which the vehicle is traveling, and/or sound radiated by the vibration of other parts of the vehicle. Therefore, unwanted noise varies with the speed, road conditions, and operating states of the vehicle.

A Road Noise Cancellation (RNC) system is a specific ANC system implemented on a vehicle in order to minimize undesirable road noise inside the vehicle cabin. RNC systems use vibration sensors to sense road induced vibration generated from the tire and road interface that leads to unwanted audible road noise. This unwanted road noise inside the cabin is then cancelled, or reduced in level, by using loudspeakers to generate sound waves that are ideally opposite in phase and identical in magnitude to the noise to be reduced at one or more listeners' ears. Cancelling such road noise results in a more pleasurable ride for vehicle passengers, and it enables vehicle manufacturers to use lightweight materials, thereby decreasing energy consumption and reducing emissions.

An Engine Order Cancellation (EOC) system is a specific ANC system implemented on a vehicle in order to minimize undesirable engine noise inside the vehicle cabin. EOC systems use a non-acoustic sensor, such as an engine speed sensor, to generate a signal representative of the engine crankshaft rotational speed in revolutions-per-minute (RPM) as a reference. This reference signal is used to generate sound waves that are opposite in phase to the engine noise that is audible in the vehicle interior. Because EOC systems use a signal from an RPM sensor, they do not require vibration sensors.

RNC systems are typically designed to cancel broadband signals, while EOC systems are designed and optimized to cancel narrowband signals, such as individual engine orders. ANC systems within a vehicle may provide both RNC and EOC technologies. Such vehicle-based ANC systems are typically Least Mean Square (LMS) adaptive feed-forward systems that continuously adapt W-filters based on noise inputs (e.g., acceleration inputs from the vibration sensors in an RNC system) and signals of physical microphones located in various positions inside the vehicle's cabin. A feature of LMS-based feed-forward ANC systems and corresponding algorithms, such as the filtered-X LMS (FxLMS) algorithm, is the storage of the impulse response, or secondary path, between each physical microphone and each anti-noise loudspeaker in the system. The secondary path is the transfer function between an anti-noise generating loudspeaker and a physical microphone, essentially characterizing how an electrical anti-noise signal becomes sound that is radiated from the loudspeaker, travels through a vehicle cabin to a physical microphone, and becomes the microphone output signal.

The remote or virtual microphone techniques are techniques in which an ANC system estimates an error signal generated by an imaginary or remote microphone at a location where no real physical microphone is located, based on the error signals received from one or more real physical microphones. These remote or virtual microphone techniques can improve noise cancellation at a listener's ears even when no physical microphone is actually located there.

Specifically, the virtual microphone technique may include additional mathematical operations that form an estimate of the anti-noise present at the virtual microphone location, a location where no actual microphone exists. The remote microphone technique builds upon the virtual microphone technique by estimating both the anti-noise and noise at the remote microphone location, a location where no actual microphone exists. One possible drawback of the remote microphone technique is that the signal processing that is desired to create the estimate of the noise at the remote microphone location incurs some time delay. This aspect has the undesirable side effect of slowing the rate of adaptation of the RNC or EOC system. A slowed rate of adaptation is undesirable in circumstances where adaptation may be needed. These include fast acceleration or gear shifts in the case of EOC, and transitions from one pavement type to another in the case of RNC.

SUMMARY

In at least one embodiment, an active noise cancellation (ANC) system is provided. The ANC system includes at least one loudspeaker, at least one microphone, a first filter, a first controllable filter, and at least one controller. The at least one loudspeaker projects anti-noise sound within a cabin of a vehicle in response to receiving an anti-noise signal. The at least one microphone provides an error signal indicative of noise and the anti-noise sound within the cabin. The first filter is programmed to modify a transfer function between the at least one microphone and at least one remote microphone location to generate an estimated remote microphone error signal based at least on the error signal. The first controllable filter generates the anti-noise signal based on the estimated remote microphone error signal. The at least one controller is programmed to receive a first signal indicative of the vehicle exhibiting a fast-adapting event and to control the first filter to execute a predetermined filter based on the first signal to reduce a group delay associated with the first filter.

In at least another embodiment, a method for performing ANC is provided. The method includes transmitting anti-noise sound within a cabin of a vehicle in response to receiving an anti-noise signal at a loudspeaker and providing an error signal indicative of noise and the anti-noise sound within the cabin. The method further includes modifying, via a first filter, to generate an estimated remote microphone error signal based at least on the error signal and generating the anti-noise signal via a first controllable filter based on the estimated remote microphone error signal. The method further includes receiving a first signal indicative of the vehicle exhibiting a fast-adapting event, and bypassing the first filter from an ANC system to reduce a group delay associated with the first filter based on the first signal In at least another embodiment, a computer-program product embodied in a non-transitory computer readable medium that is programmed for performing ANC. The computer-program product includes instructions for transmitting anti-noise sound within a cabin of a vehicle in response to receiving an anti-noise signal at a loudspeaker and providing an error signal indicative of noise and the anti-noise sound within the cabin. The computer-program product further includes instructions for modifying, via a first filter, to generate an estimated remote microphone error signal based at least on the error signal and generating the anti-noise signal via a first controllable filter based on the estimated remote microphone error signal. The computer-program product further includes instructions for receiving a first signal indicative of the vehicle exhibiting a fast-adapting event and controlling the first filter to execute a predetermined filter based on the first signal to reduce a group delay associated with the first filter.

DETAILED DESCRIPTION

Figure 1:
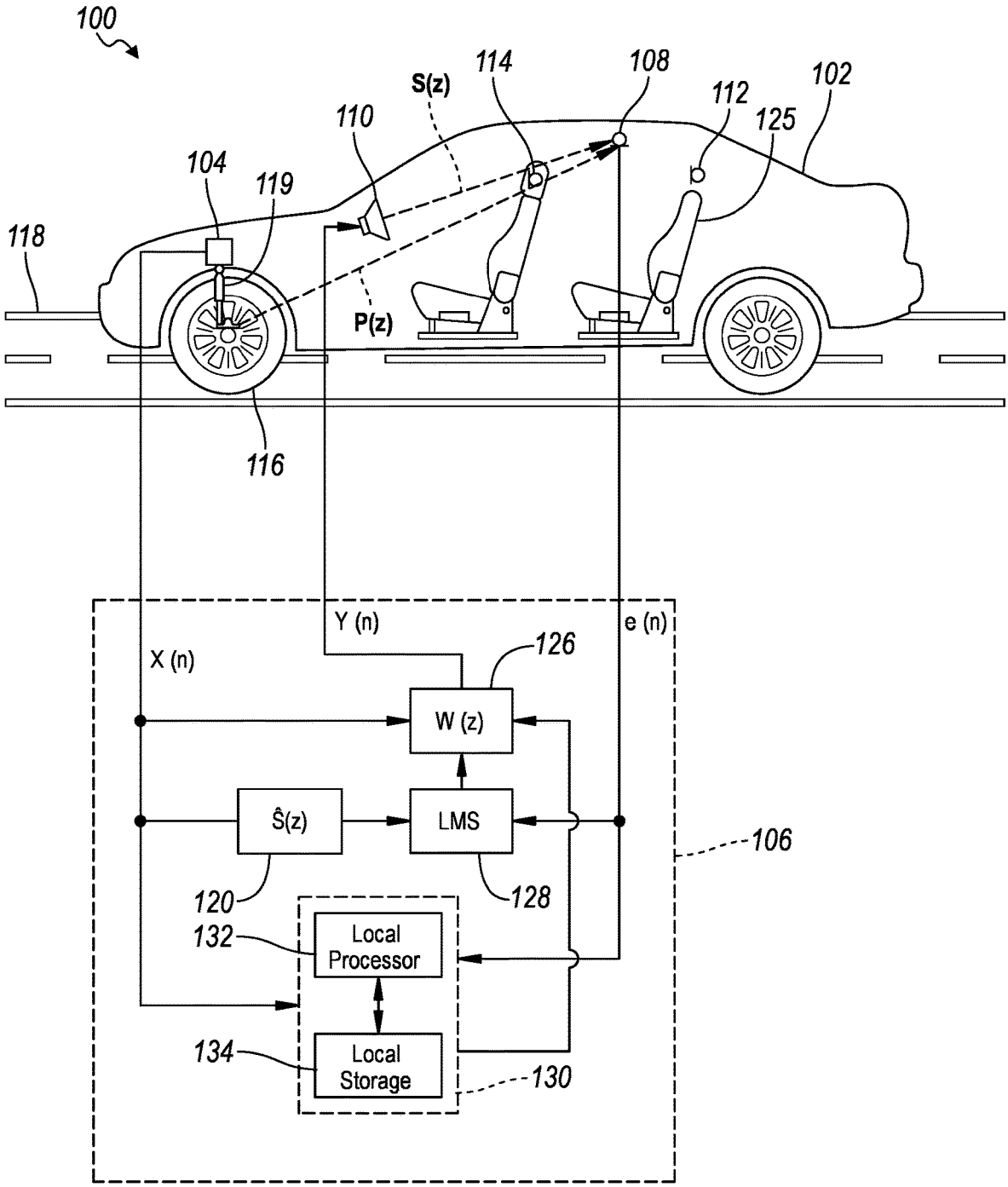
FIG. 1 is a schematic diagram of a vehicle having an active noise cancellation (ANC) system including a road noise cancellation (RNC) and a remote microphone, in accordance with one or more embodiments.

As required, detailed embodiments of the present disclosure are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Despite the proliferation of electric vehicles, Internal Combustion Engine (ICE) based EOC systems remain necessary to the automotive industry today. It is expected that this will remain true for some time, especially for regular or any heavy-duty trucks. Among the more recent challenges for EOC systems are engines with cylinder deactivation and dynamic skip fire engines. These types of engines can instantaneously and sometimes frequently change their cylinder firing sequence by changing the number of cylinders that fire, thereby changing the engine orders created and their amplitudes.

A Virtual Microphone (VM) or Remote Microphone (RM) topology noise cancellation has been developed to center the region of noise cancellation closer to the expected region of vehicle occupant's ears. The VM and RM technology has been developed and implemented for both Engine Order Cancellation (EOC) systems and Road Noise Cancellation (RNC) systems. The RM RNC and EOC systems are actually similar to the VM systems but carries an undesirable extra group delay.

EOC systems can fully adapt (e.g., compensate for engine noise) in less than, for example, 100 ms. This may be sufficient to ensure that the EOC system adapts to gear shifts or dynamic cylinder deactivation, which are accompanied by abrupt changes in an engine revolutions per minute (RPM) guiding signal and engine order content respectively. EOC systems may utilize a remote microphone technique as developed by Applicant, which may be one way to extend the noise cancellation perceived by vehicle occupants to a higher frequency. One limiting factor may be the group delay caused by a filter (e.g., PathPR filter) that may be needed for the RM based EOC system to adapt and correct a controllable filter (e.g., W-filter) also in the system. This may create anti-noise that is ideal for noise cancellation at the location of the passenger's ears. In steady state driving conditions, the RPM is approximately constant, and so any additional group delay incurred by the PathPR filter has essentially no deleterious effect. However, in dynamic driving scenarios, such as Wide-Open Throttle (WOT), the RPM is changing quickly upwards, and there may also be abrupt (and discontinuous) downward changes in RPM due to gear shifts.

In an embodiment, the extra group delay incurred by a finite impulse response (FIR) based PathPR filter in this case may substantially lower the perceived engine noise cancellation because it effectively delays the adaptation of the system's W-filters. In other words, the extra group delay incurred by the PathPR filter in the RM EOC technique (e.g., algorithm, technique or system) can substantially lower the perceived engine noise cancellation during dynamic driving scenarios where EOC is most needed, such as for WOT. Further, to attain increased fuel efficiency, cylinder deactivation or rapidly changing, dynamic skip fire methods of decrementing the engine cylinders that are firing, can instantaneously change the engine orders that are created. In these dynamic engine operation scenarios, it is advisable to quickly change the PathPR filter to a predetermined filter, such as for example, an identity matrix, thereby bypassing the PathPR filter, and eliminating the group delay in effort to improve the noise cancellation performance. By "eliminating" the PathPR filter, the RM EOC technique essentially becomes similar to a VM EOC system.

In the case of RNC systems, the PathPR filter also incurs an additional delay that also delays the adaptation. In steady state driving conditions on a particular pavement, the W-filters have fully adapted, and so any additional group delay incurred by the PathPR filter has essentially no deleterious effect. However, when the vehicle encounters a transition from one pavement type to a second pavement type, or when a vehicle suddenly accelerates to a faster speed, adaptation of the W-filters is necessary to ensure optimal road noise cancellation. The extra group delay incurred by a finite impulse response (FIR) based PathPR filter, in this case, may substantially lower the perceived road noise cancellation because it effectively delays the adaptation of the system's W-filters. In such dynamic driving scenarios, it is advisable to quickly change the PathPR filter to a predetermined filter such as, for example, an identity matrix, thereby bypassing the PathPR filter, and eliminating the group delay in effort to gain extra noise cancellation performance. By "eliminating" the PathPR filter, the RM RNC system essentially becomes similar to a VM RNC topology.

With reference to FIG. 1, a RNC system is illustrated in accordance with one or more embodiments and generally represented by numeral 100. The RNC system 100 is depicted within a vehicle 102 having one or more vibration sensors 104. The vibration sensors 104 are disposed throughout the vehicle 102 to monitor the vibratory behavior of the vehicle's suspension, subframe, as well as other axle and chassis components. The RNC system 100 may be integrated with a broadband adaptive feed-forward active noise cancellation (ANC) system 106 that generates anti-noise by adaptively filtering the signals from the vibration sensors 104 using one or more physical microphones 108. The anti-noise signal may then be played through one or more loudspeakers 110 to become sound within a room, such as a passenger cabin of the vehicle 102. S(z) represents a transfer function between a single loudspeaker 110 and a single microphone 108. The ANC system 106 evaluates measured signals to determine the resonance frequency of each loudspeaker 110, and adaptively adjusts a secondary path parameter based on the resonance frequency to limit or eliminate noise boosting in the affected frequency ranges.

While FIG. 1 shows a single vibration sensor 104, microphone 108, and loudspeaker 110 for simplicity purposes only, it should be noted that typical RNC systems use multiple vibration sensors 104 (e.g., ten or more), microphones 108 (e.g., four to six), and loudspeakers 110 (e.g., four to eight). The ANC system 106 may also include one or more remote microphones 112, 114 that are used for adapting anti-noise signal(s) that are optimized for the occupants in the vehicle 102, according to one or more embodiments.

The vibration sensors 104 may include, but are not limited to, accelerometers, force gauges, geophones, linear variable differential transformers, strain gauges, and load cells. Accelerometers, for example, are devices whose output signal amplitude is proportional to acceleration. A wide variety of accelerometers are available for use in RNC systems. These include accelerometers that are sensitive to vibration in one, two and three typically orthogonal directions. These multi-axis accelerometers typically have a separate electrical output (or channel) for vibration sensed in their X-direction, Y-direction and Z-direction. Single-axis and multi-axis accelerometers, therefore, may be used as vibration sensors 104 to detect the magnitude and phase of acceleration and may also be used to sense orientation, motion, and vibration.

Noise and vibration that originates from a wheel 116 moving on a road surface 118 may be sensed by one or more of the vibration sensors 104 mechanically coupled to a suspension device 119 or a chassis component of the vehicle 102. The vibration sensor 104 may output a noise signal X(n), which is a vibration signal that represents the detected road-induced vibration. It should be noted that multiple vibration sensors are possible, and their signals may be used separately, or may be combined. In certain embodiments, a microphone may be used in place of a vibration sensor to output the noise signal X(n) indicative of noise generated from the interaction of the wheel 116 and the road surface 118. The noise signal X(n) may be filtered with a modeled transfer characteristic $\hat{S}(z)$, which estimates the secondary path (i.e., the transfer function between an anti-noise loudspeaker 110 and a physical microphone 108), by a secondary path filter 120.

Road noise that originates from the interaction of the wheel 116 and the road surface 118 is also transferred, mechanically and/or acoustically, into the passenger cabin and is received by the one or more microphones 108 inside the vehicle 102. The one or more microphones 108 may, for example, be located in a headliner of the vehicle 102, or in some other suitable location to sense the acoustic noise field heard by occupants inside the vehicle 102, such as an occupant sitting on a rear seat 125. The road noise originating from the interaction of the road surface 118 and the wheel 116 is transferred to the microphone 108 according to a transfer characteristic P(z), which represents the primary path (i.e., the transfer function between an actual noise source and a physical microphone).

The microphone 108 may output an error signal e(n) representing the sound present in the cabin of the vehicle 102 as detected by the microphone 108, including noise and anti-noise. In the RNC system 100, an adaptive transfer characteristic W(z) of a controllable filter 126 may be controlled by adaptive filter controller 128, which may operate according to a known least mean square (LMS) algorithm based on the error signal e(n) and the noise signal X(n) filtered with the modeled transfer characteristic 3(z), by the secondary path filter 120. The controllable filter 126 is often referred to as a W-filter. An anti-noise signal Y(n) may be generated by the controllable filter or filters 126 and the vibration signal, or a combination of vibration signals X(n). The anti-noise signal Y(n) ideally has a waveform such that when played through the loudspeaker 110, anti-noise is generated near the occupants' ears and the microphone 108, that is substantially opposite in phase and identical in magnitude to that of the road noise audible to the occupants of the vehicle cabin. The anti-noise from the loudspeaker 110 may combine with road noise in the vehicle cabin near the microphone 108 resulting in a reduction of road noise-induced sound pressure levels (SPL) at this location. In certain embodiments, the RNC system 100 may receive sensor signals from other acoustic sensors in the passenger cabin, such as an acoustic energy sensor, an acoustic intensity sensor, or an acoustic particle velocity or acceleration sensor to generate error signal e(n).

While the vehicle 102 is under operation, at least one controller 130 (hereafter "the controller 130") may collect and process the data from the vibration sensors 104 and the microphones 108. The controller 130 includes a processor 132 and storage 134. The processor 132 collects and processes the data to construct a database or map including data and/or parameters to be used by the vehicle 102. The data collected may be stored locally in the storage 134, or in the cloud, for future use by the vehicle 102. Examples of the types of data related to the RNC or EOC system 106 that may be useful to store locally at storage 134 include, but are not limited to, acceleration thresholds in the form of accelerator pedal position, accelerator rate of change of position, torque thresholds, rate of change of torque thresholds, engine order harmonic threshold frequencies, statistics related to pavement type detection in the form of microphone or accelerometer signal crest factor, amplitudes, spectra, FFT profiles, third-octave bin profiles, etc.

Although the controller 130 is shown as a single controller, it may include multiple controllers, or it may be embodied as software code within one or more other controllers, such as the adaptive filter controller 128. The controller 130 generally includes any number of microprocessors, ASICs, ICs, memory (e.g., FLASH, ROM, RAM, EPROM and/or EEPROM) and software code to co-act with one another to perform a series of operations. Such hardware and/or software may be grouped together in modules to perform certain functions. Any one or more of the controllers or devices described herein include computer executable instructions that may be compiled or interpreted from computer programs created using a variety of programming languages and/or technologies. In general, a processor, e.g., the processor 132 receives instructions, for example from a memory, e.g., the storage 134, a computer-readable medium, or the like, and executes the instructions. A processing unit is a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof. The controller 130 also includes predetermined data, or "look up tables" that are stored within the memory, according to one or more embodiments.

As previously described, typical RNC systems may use several vibration sensors, microphones and loudspeakers to sense structure-borne vibratory behavior of a vehicle and generate anti-noise. The vibration sensors may be multi-axis accelerometers having multiple output channels. For instance, triaxial accelerometers typically have a separate electrical output for vibrations sensed in their X-direction, Y-direction, and Z-direction. A typical configuration for an RNC system may have, for example, six error microphones, six loudspeakers, and twelve channels of acceleration signals coming from four triaxial accelerometers or six dual-axis accelerometers. Therefore, the RNC system will also include multiple S'(z) filters (e.g., secondary path filters 120, or S(z) filters) and multiple W(z) filters (e.g., controllable filters 126).

The simplified RNC system schematic depicted in FIG. 1 shows one secondary path, represented by S(z), between the loudspeaker 110 and the microphone 108. As previously mentioned, RNC systems typically have multiple loudspeakers, microphones and vibration sensors. Accordingly, a six-speaker, six-microphone RNC system will have thirty-six total secondary paths (i.e., 6×6). Correspondingly, the six-speaker, six-microphone RNC system may likewise have thirty-six $\hat{S}(z)$ filters (i.e., secondary path filters 120), which estimate the transfer function for each secondary path. As shown in FIG. 1, an RNC system will also have one W(z) filter (i.e., controllable filter 126) between each noise signal X(n) from a vibration sensor (i.e., accelerometer) 104 and each loudspeaker 110. Accordingly, a twelve-accelerometer signal, six-speaker RNC system may have seventy-two W(z) filters. The relationship between the number of accelerometer signals, loudspeakers, and W(z) filters is illustrated in FIG. 2.

Figure 2:
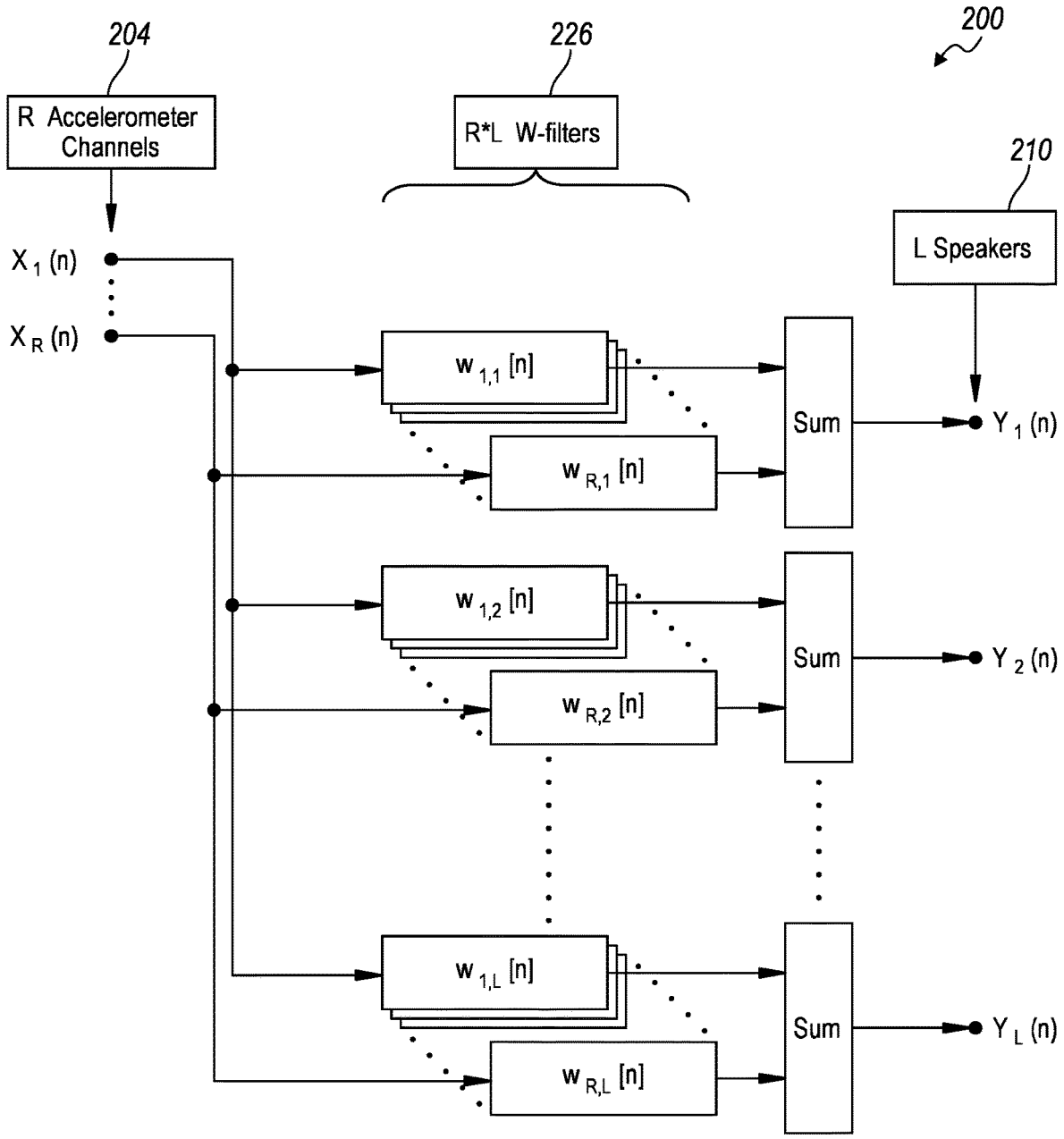
FIG. 2 is a sample schematic diagram demonstrating relevant portions of an RNC system scaled to include R accelerometer signals and L loudspeaker signals.

FIG. 2 is a sample schematic diagram demonstrating relevant portions of an RNC system 200 scaled to include R accelerometer signals [X1(n), X2(n), . . . XR(n)] from accelerometers 204 and L loudspeaker signals [Y1(n), Y2(n), . . . YL(n)] from loudspeakers 210. Accordingly, the RNC system 200 may include R*L controllable filters (or W-filters) 226 between each of the accelerometer signals and each of the loudspeakers. As an example, an RNC system having twelve accelerometer outputs (i.e., R=12) may employ six dual-axis accelerometers or four triaxial accelerometers. In the same example, a vehicle having six loudspeakers (i.e., L=6) for reproducing anti-noise, therefore, may use seventy-two W-filters in total. At each of the L loudspeakers, R W-filter outputs are summed to produce the loudspeaker's anti-noise signal Y(n). Each of the L loudspeakers may include an amplifier (not shown). In one or more embodiments, the R accelerometer signals filtered by the R W-filters are summed to create an electrical anti-noise signal y(n), which is fed to the amplifier to generate an amplified anti-noise signal Y(n) that is sent to a loudspeaker.

The ANC system 106 illustrated in FIG. 1 may also include an engine order cancellation (EOC) system. As mentioned above, EOC technology uses a non-acoustic signal such as an engine speed signal representative of the engine crankshaft rotational speed as a reference in order to generate sound that is opposite in phase to the engine noise audible in the vehicle interior. EOC systems may utilize a narrowband feed-forward ANC framework to generate anti-noise using an engine speed signal to guide the generation of an engine order signal identical in frequency to the engine order to be cancelled, and adaptively filtering it to create an anti-noise signal. After being transmitted via a secondary path from an anti-noise source to a listening position or physical microphone, the anti-noise ideally has the same amplitude, but opposite phase, as the combined sound generated by the engine and exhaust pipes after being filtered by the primary paths that extend from the engine to the listening position and from the exhaust pipe outlet to the listening position or physical or remote microphone position. Thus, at the place where a physical microphone resides in the vehicle cabin (i.e., most likely at or close to the listening position), the superposition of engine order noise and anti-noise would ideally become zero so that acoustic error signal received by the physical microphone would only record sound other than the (ideally cancelled) engine order or orders generated by the engine and exhaust.

Commonly, a non-acoustic sensor, for example an engine speed sensor, is used as a reference. Engine speed sensors may be, for example, Hall Effect sensors which are placed adjacent to a spinning steel disk. Other detection principles can be employed, such as optical sensors or inductive sensors. The signal from the engine speed sensor can be used as a guiding signal for generating an arbitrary number of reference engine order signals corresponding to each of the engine orders. The reference engine orders form the basis for noise cancelling signals generated by the one or more narrowband adaptive feed-forward LMS blocks that form the EOC system.

Figure 3:
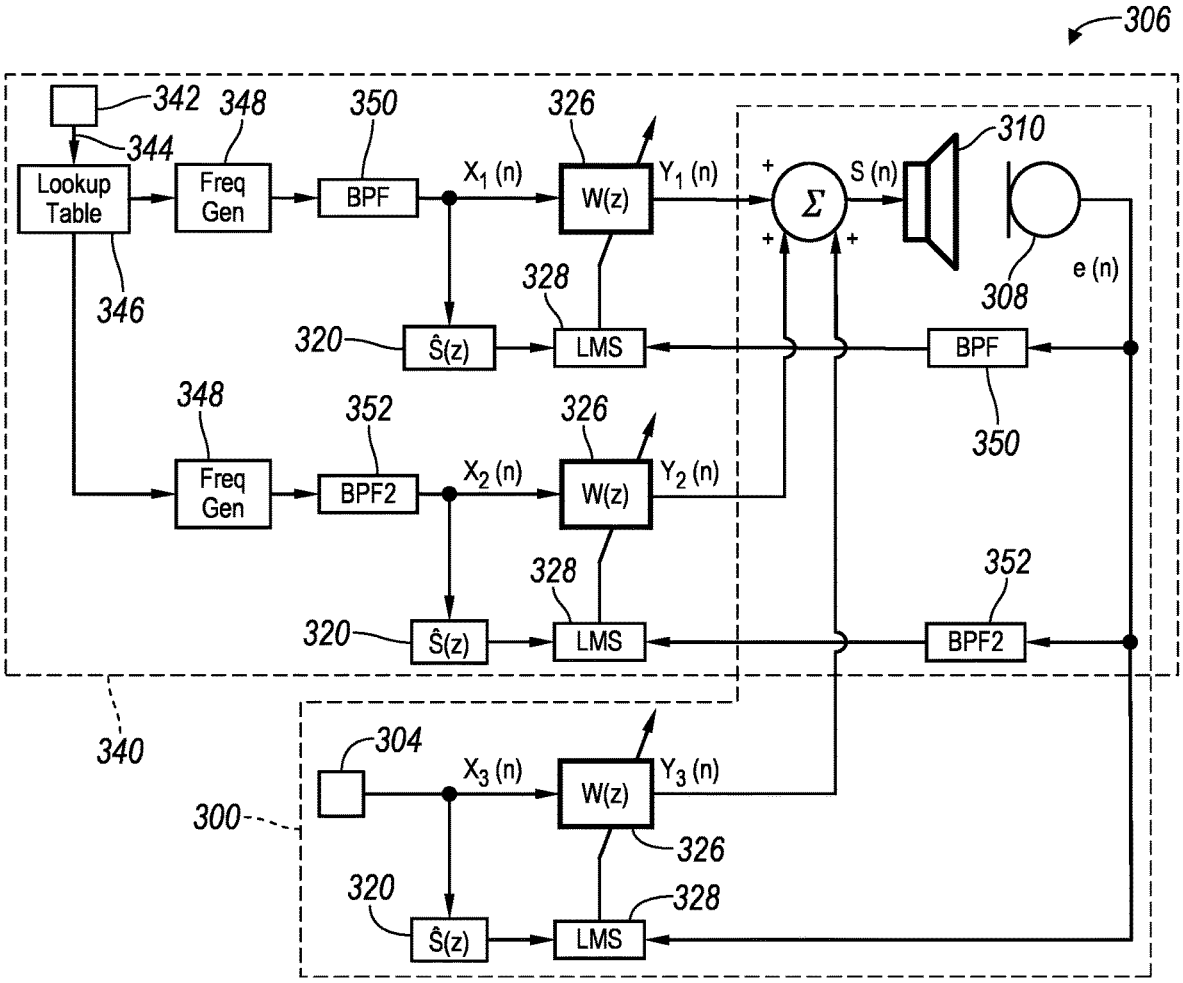
FIG. 3 is a sample schematic block diagram of an ANC system including an engine order cancellation (EOC) system and an RNC system.

FIG. 3 is a schematic block diagram illustrating an example of an ANC system 306, including both an RNC system 300 and an EOC system 340. Similar to RNC system 100, the RNC system 300 may include a vibration sensor 304, a physical microphone 308, a loudspeaker 310, a secondary path filter 320, a w-filter 326, and an adaptive filter controller 328, consistent with operation of the vibration sensor 104, the physical microphone 108, the loudspeaker 110, the secondary path filter 120, the w-filter 126, and the adaptive filter controller 128, respectively, discussed above.

The EOC system 340 may include an engine speed sensor 342 to provide an engine speed signal 344 (e.g., a square-wave signal) indicative of rotation of an engine crank shaft or other rotating shaft such as the drive shaft, half shafts or other shafts whose rotational rate is aligned with vibrations coupled to vehicle components that lead to noise in the passenger cabin. In some embodiments, the engine speed signal 344 may be obtained from a vehicle network bus (not shown). As the radiated engine orders are directly proportional to the crank shaft RPM, the engine speed signal 344 is representative of the frequencies produced by the engine and exhaust system. Thus, the signal from the engine speed sensor 342 may be used to generate reference engine order signals corresponding to each of the engine orders for the vehicle. Accordingly, the engine speed signal 344 may be used in conjunction with a lookup table 346 of Engine Speed (RPM) vs. Engine Order Frequency, which provides a list of engine orders radiated at each engine speed. The frequency generator 348 may take as an input the Engine Speed (RPM) and generate a sine wave for each order based on this lookup table 346.

The frequency of a given engine order at the sensed Engine Speed (RPM), as retrieved from the lookup table 346, may be supplied to a frequency generator 348, thereby generating a sine wave at the given frequency. This sine wave represents a noise signal X(n) indicative of engine order noise for a given engine order. Similar to the RNC system 300, this noise signal X(n) from the frequency generator 348 may be sent to an adaptive controllable filter 326, or W-filter, which provides a corresponding anti-noise signal Y(n) to the loudspeaker 310. As shown, various components of this narrow-band, EOC system 340 may be identical to the broadband RNC system 300, including the physical microphone 308, adaptive filter controller 328 and secondary path filter 320. The anti-noise signal Y(n), broadcast by the loudspeaker 310 generates anti-noise that is substantially out of phase but identical in magnitude to the actual engine order noise at the location of a listener's ear, which may be in close proximity to a physical microphone 308, thereby reducing the sound amplitude of the engine order. Because engine order noise is narrow band, the error signal e(n) may be filtered by a bandpass filter 350 prior to passing into the LMS-based adaptive filter controller 328. In an embodiment, proper operation of the LMS adaptive filter controller 328 is achieved when the noise signal X(n) output by the frequency generator 348 is bandpass filtered using the same bandpass filter parameters.

In order to simultaneously reduce the amplitude of multiple engine orders, the EOC system 340 may include multiple frequency generators 348 for generating a noise signal X(n) for each engine order based on the engine speed signal 344. As an example, FIG. 3 shows a two order EOC system having two such frequency generators for generating a unique noise signal (e.g., X1(n), X2(n), etc.) for each engine order based on engine speed. Because the frequency of the two engine orders differ, the bandpass filters 350, 352 (labeled BPF and BPF2) have different high- and low-pass filter corner frequencies. The number of frequency generators and corresponding noise-cancellation components will vary based on the number of engine orders to be cancelled for a particular engine of the vehicle. As the two-order EOC system 340 is combined with the RNC system 300 to form the ANC system 306, the anti-noise signals Y(n) output from the three controllable filters 326 are summed and sent to the loudspeaker 310 as a loudspeaker signal S(n). Similarly, the error signal e(n) from the physical microphone 308 may be sent to the three LMS adaptive filter controllers 328.

Figure 4:
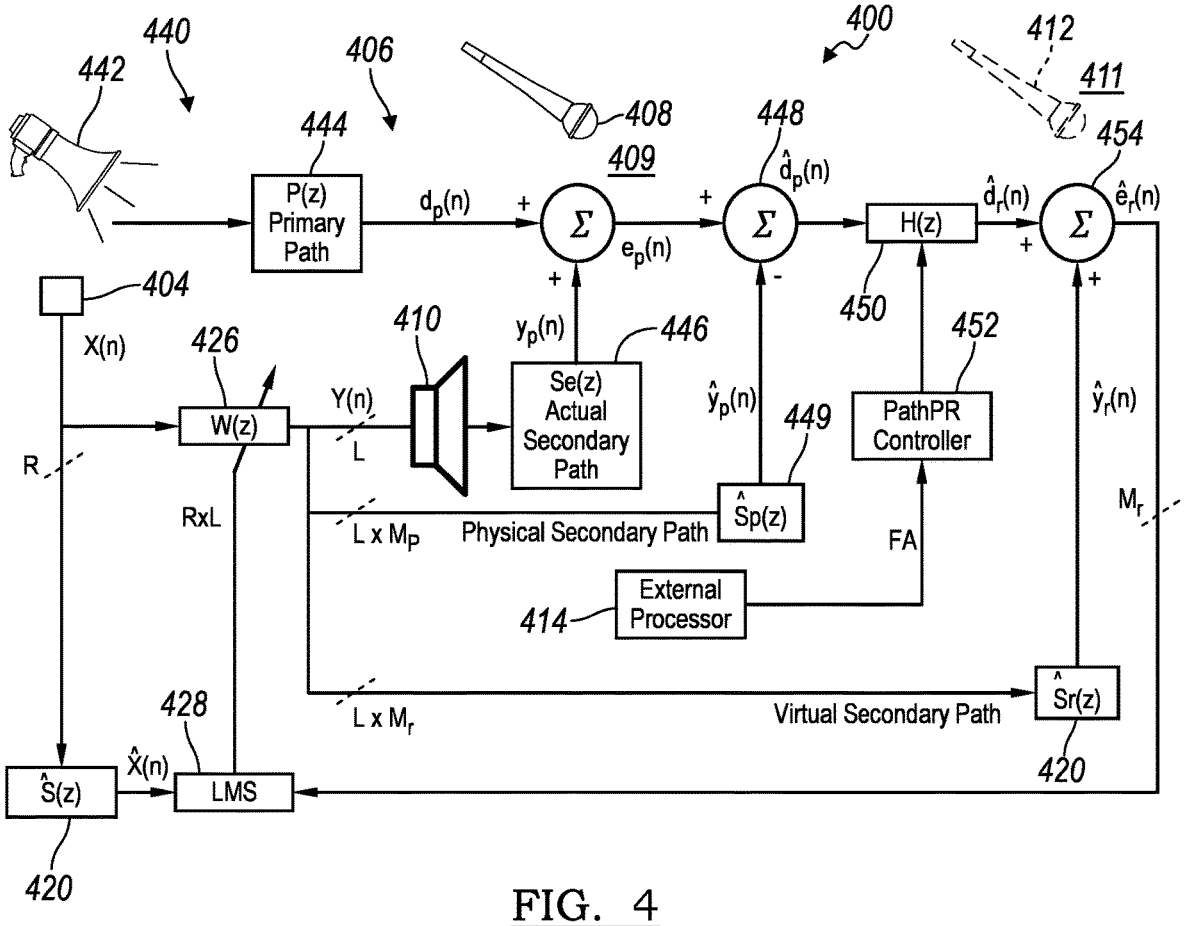
FIG. 4 is a schematic block diagram representing an EOC or RNC system of the ANC system to account for dynamic skip fire engines and scenarios utilizing fast adaptation in accordance with one or more embodiments of the present disclosure.

FIG. 4 is a schematic block diagram of a vehicle-based remote microphone (RM) ANC system 406 showing many of the key ANC system parameters that may be used to, inter alia, improve noise cancellation or limit or eliminate noise boosting. For ease of explanation, the ANC system 406 illustrated in FIG. 4 is shown with components and features of an RNC system 400 and an EOC system 440. Accordingly, the RM ANC system 406 is a schematic representation of an RNC and/or EOC system, such as those described in connection with FIGS. 1-3, featuring additional system components of the RM ANC system 406. Similar components may be numbered using a similar convention.

For instance, similar to ANC system 106, the RM ANC system 406 may include a vibration sensor 404, a physical microphone 408, a controllable filter (or w-filter) 426, at least one controller 428 (or hereafter "an adaptive filter controller 428"), a remote secondary path filter 420, and a loudspeaker 410, consistent with operation of the vibration sensor 104, the physical microphone 108, the w-filter 126, the adaptive filter controller 128, the secondary path filter 120, and the loudspeaker 110, respectively, discussed above. FIG. 4 also shows a primary path P(z) 444 and a secondary path Se(z) 446 in block form for illustrative purposes.

One or more objects as desired by the RM ANC system 406 involves estimating a virtual microphone (or remote microphone) 412 at a remote location 411. The remote microphone 412 corresponds to a remote microphone signal generated by the system 406 that provides a signal estimate to estimate acoustic pressure at a different location than a physical microphone location 409, for example at a location that is proximate to (or adjacent to) a listener's ears. This aspect will be described in more detail in connection with FIGS. 5A-5B. The virtual or remote microphone 412 is not a physical microphone but simply serves as a designation to illustrate a signal that is an estimate of the acoustic pressure that is proximate to a listener's ears.

Figure 5A:
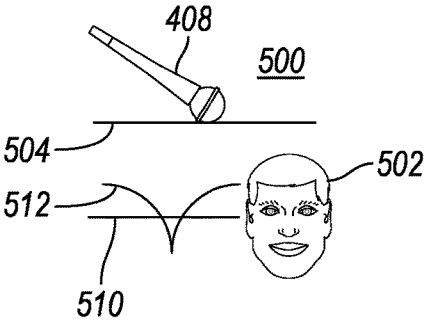
FIG. 5A depicts one example of controlled noise that is generated distally from a user.
Figure 5B:
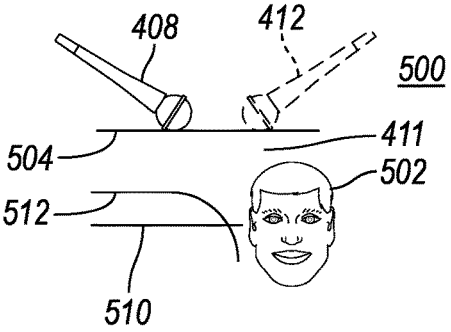
FIG. 5B depicts one example of controlled noise that is generated proximately to a user's ear.

FIG. 5A depicts a listener (or user) 502 that may be positioned in a vehicle 500. The vehicle 500 includes a headliner 504 positioned above the user 502. In general, the microphone 408 may be positioned in the headliner 504 and is generally used in connection with ANC applications and more particularly in connection with EOC and RNC applications. Primary noise is generally depicted by 510 and is received by the ears of the user 502. The EOC system 440 generally adapts the controllable filter 426 to minimize energy for noise signals received at the error microphone 408. This creates a zone of "silence" around the location of the microphone 408 with the quietest location being at the location of the microphone 408. In this case, note that since the microphone 408 is positioned on the headliner 504, the quietest location is not proximate or directly adjacent to the ears of the user 502 (e.g., see controlled noise as depicted by 512 where the minimum amount of noise is much less than the primary noise level 510 at the location of the microphone 408 which is positioned a distance away from the user 502). In this case, it can be seen that the controlled noise 512 is higher in level than the primary noise at the location of the ears' of the user 502. The ANC system 406 may generate the remote microphone 412 signal at a remote microphone location 411 (see FIG. 5B) that is positioned proximate to the ears of the user 502 such that the controlled noise 512 exhibits a minimum proximate to the user's ears at the location 411 of the remote microphone 412. Consequently, the corresponding quiet zone created through the use of the remote microphone 412 is positioned directly adjacent to the ears of the user 502.

Referring back to FIG. 4, the RM ANC system 406 also includes a controllable filter 450 (or a PathPR filter or microphone transfer function 450). The physical microphone 408 is generally positioned at a physical mic location 409. The physical microphone 408 senses the acoustic pressure at the location 409. As noted above in connection with FIG. 5B, it may be desirable to generate the remote microphone 412 (see the remote microphone) as provided by the system 406 at the remote microphone location 411 that is proximate to the user's ears. Thus, in this regard, the PathPR filter 450 is used to generate an estimate of the primary noise to be cancelled at the remote microphone location 411 based on the measured noise at the location of the physical microphone 409. For example, the remote microphone 412 provides a signal $\hat{e}_r(n)$ generated by the system 406 that is an estimate of the pressure at the location of the remote microphone 411.

The physical microphone 408 provides an error signal $e_p(n)$ that includes all the sound present at its location, such as the disturbance signal $d_p(n)$ intended to be cancelled, which includes road noise, engine and exhaust noise, plus the anti-noise from the loudspeaker 410, $y_p(n)$, and any extraneous sounds at the microphone location.

As noted above, the physical microphone 408 represents a microphone located at the actual microphone location 409 that would similarly sense all the sound at its location 409, such as the disturbance signal $d_p(n)$ to be cancelled, which includes road noise, engine, and exhaust noise, plus the anti-noise from the loudspeaker 410, $y_p(n)$, and extraneous sounds. Typically, there are multiple physical microphone locations 409, and multiple remote microphone locations 411. As suggested above, when operating the noise cancellation system, there is no actual microphone mounted at the remote microphone location 411. So, with the remote microphone technique, the pressure at the remote microphone locations 411 is estimated from the pressure at the physical microphone locations 409 to form an estimated error signal $\hat{e}_r(n)$. It is recognized that the RM ANC system 406 may correspond to a RM EOC system 440 or an RM RNC system 400.

The physical microphone 408 senses both the noise $d_p(n)$ at its location 409 from a noise source 442 after traveling along a primary path P(z) 444 and the anti-noise $y_p(n)$ at its location from the loudspeaker 410 after traveling along the secondary path Se(z) 446. The physical microphone 408 provides a physical error signal $e_p(n)$, as shown by Equation 1:

$$e_p(n)=d_p(n)+y_p(n) \tag{1}$$

The RM EOC system 440 estimates the disturbance noise to be cancelled $\hat{d}_p(n)$ at the physical microphone location at block 448 (or adder 448). The ANC system 406 subtracts an estimate of the anti-noise at the physical microphone location $\hat{y}_p(n)$ (e.g., 409) from the physical error signal $e_p(n)$ to estimate the disturbance noise at the physical microphone location $\hat{d}_p(n)$, as shown by Equation 2:

$$\hat{d}_p(n)=e_p(n)-\hat{y}_p(n) \tag{2}$$

The RM EOC system 440 then estimates the disturbance noise to be cancelled at the remote microphone location $\hat{d}_v(n)$ at the PathPR filter 450 by convolving the estimated disturbance noise at the physical microphone location $\hat{d}_p(n)$ with the transfer function between the physical and remote microphone location 11(*z*). In one example, the ANC system 406 includes a PathPR controller 452 that receives fast adaptation (FA) signal(s) from one or more external processors 414 (hereafter "the external processor 414). Any one or more of the external processors 132, 414 may be positioned in the vehicle. The PathPR controller 452 adjusts tuning parameters, such as, for example, H-filters 450 that may also be known as PathPR filters, based on a need for faster adaptation of the ANC system 406 and further based on the operating conditions of the vehicle.

At block 454, the RM ANC system 406 estimates the remote microphone error signal $\hat{e}_r(n)$ that would be present at the location 411 of the remote microphone 412 by adding the estimated disturbance noise to be cancelled at the remote microphone location $\hat{d}_r(n)$ with an estimate of the anti-noise at the location 411 $\hat{y}_r(n)$ as shown by Equation 3:

$$\hat{e}_r(n)=\hat{d}_r(n)+\hat{y}_r(n) \tag{3}$$

Combining Equations 1, 2 and 3 creates an estimate of the remote error microphone signal or signals, from the physical error signal or signals, the physical and remote microphone secondary path and the transfer functions between the physical and remote locations (e.g., PathPR).

Similar to FIG. 3, the noise signal X(n) from the noise input, as derived from a combination of signals received from the RPM sensor 342, the lookup table 346, and the frequency generator 348, may be filtered with a modeled transfer characteristic $\hat{S}(z)$, using stored estimates of the remote secondary path as previously described, by the remote secondary path filter 420 to obtain a filtered noise signal $\hat{X}(z)$. Moreover, a transfer characteristic W(z) of the controllable filter 426 (e.g., a W-filter) may be controlled by the LMS adaptive filter controller (or simply LMS controller) 428 to provide an adaptive filter 426. The LMS adaptive filter controller 428 receives the filtered noise signal $\hat{X}(z)$ and the estimated remote error signal $\hat{e}_r(n)$ to adapt the W-filters to produce optimized noise cancellation at the location of the remote microphone 411. The controllable filter 426 generates the anti-noise signal Y(n) based on the noise signal X(n). The adaptive filter controller 428 generates the W-filters in the controllable filter 426.

Similar to FIG. 2, the ANC system 406 is scaled to include R reference noise signals (e.g., accelerometer noise signals or frequency generator signals), L loudspeaker or loudspeaker signals, and M microphone error signals. Accordingly, the ANC system 506 may include R*L controllable filters (or W-filters) 426 and L anti-noise signals.

In general, the RM EOC system 440 generally transforms a time domain-based microphone signal $e_p(n)$ (e.g., which is a measurement of the combined engine noise and engine anti-noise at the location of the physical microphone 408) into a time-domain based estimated remote error signal $\hat{e}_r(n)$ that is an estimate of the noise and antinoise at the location 411 of the remote microphone 412 which in an embodiment is the location of a passenger's ear. In an embodiment, there is a frequency domain version of this time domain process. As noted above, this is performed via the block 448 by subtracting off an estimate of the anti-noise at the location of the remote microphone 412 and the anti-noise at this location $\hat{y}_r(n)$ to form an estimate of only the engine noise $\hat{e}_r(n)$ at the location 411 of the remote microphone 412. Then for the RM EOC system 440, the PathPR filter 450 is applied to form an estimate of the noise at the location of the remote microphone(s) 412 (e.g., $\hat{e}_r(n)$) based on the estimate of the noise at the error microphone(s) 408 (e.g., $e_p(n)$). As such, the PathPR filter 450 undesirably adds group delay to the estimation of $\hat{e}_r(n)$. The difference between a RM EOC system and a VM EOC system is in the value of the PathPR filter 450. For a VM EOC system, the engine noise at these two locations 409 and 411 is assumed to be identical, meaning that the PathPR filter 450 is omitted. Alternately, the PathPR filter 450 can be bypassed using a variety of functionally equivalent signal processing methods such as applying a predetermined filter such an, for example, an identity matrix, which effectively omits the PathPR filter 450. Then, both VM and RM EOC systems add on an estimate of the anti-noise at the location of the virtual or remote microphone 412. So, both VM and RM EOC systems account for the spatial (and temporal) variation of the anti-noise field created by the loudspeaker 410. In this regard, the loudspeaker 410 may be positioned on a headrest or on a seat, which places the loudspeaker 410 in close proximity to the occupant's ears. In typical systems, a spatial and temporal (i.e., delay) variation of the anti-noise field may be greater than that of the engine noise or road noise field. This is due in part to the anti-noise field created by a source that is much closer to the passenger's ears than the noise field. As mentioned earlier, due to the PathPR filter 450, the RM EOC system 440 adds an undesirable delay to the estimated remote microphone error signal $\hat{e}_r(n)$. It is this undesirable delay that may be eliminated from the RM ANC system 440 by using the PathPR controller 452 to bypass the PathPR filter 450, or to control the PathPR filter 450 to execute a predetermined filter, such as for example, an identity matrix (e.g., a matrix of diagonal one's which can effectively bypass the PathPR filter 450) in dynamic driving scenarios when it is desirable for the EOC system 440 to adapt faster.

As noted above, one limiting factor may be the group delay caused by the PathPR filter 450 that may be needed for the RM EOC system 440. This may create anti-noise that is ideal for noise cancellation at or nearer to the location of the passenger's ears than to location 409. In steady state driving conditions, engine RPM is approximately constant, and so any additional group delay incurred by the PathPR filter 450 filter has essentially no effect. However, in dynamic driving scenarios involving rapid acceleration events, such as during Wide-Open Throttle (WOT), the RPM is changing quickly upwards, and there may also be abrupt (and discontinuous) downward changes in RPM due to gear shifts. The extra group delay incurred by the PathPR filter 450, in this case, may substantially lower the amount of perceived engine noise cancellation in the time immediately following the rapid RPM change, due to the need for the LMS controller 428 to adapt the W-filter 426. In these driving scenarios such as fast adaptation events or rapid acceleration events, it is desirable to change the PathPR filter 450 to an identity matrix, thereby bypassing the PathPR filter 450, and eliminating the group delay in effort to gain extra noise cancellation performance. By providing an identity matrix substitution (or filter substitution), bypassing or actually removing the PathPR filter 450, the RM based EOC system 401 effectively becomes a virtual microphone based EOC technique. Rapid acceleration events may be generally defined as a condition in which accelerator pedal position indicates the driver's desire for the vehicle to increase in speed beyond a predetermined threshold. Other signals that can be used to identify a rapid acceleration even include, but not limited to, a rate of change of wheel RPM, a rate of change of engine RPM, a rate of change of global positioning system (GPS) determined vehicle location, a rate of change of measured engine order harmonic frequency, a rate of change of engine torque, a rate of change of speed, and a rate of change of acceleration, termed "jerk" by physicists.

In general, the extra group delay incurred by the PathPR filter 450 in the remote microphone EOC based technique (or algorithm) can substantially lower the perceived engine noise cancellation at the beginning of and during dynamic driving scenarios where EOC is most needed, such as during a wide-open-throttle (WOT) condition where the accelerator pedal is fully depressed. Note that a partially open throttle (POT) with the accelerometer depressed further than a threshold can also be considered a rapid acceleration event. In these dynamic scenarios, also termed rapid acceleration events or fast adaptation events, it is advisable to quickly bypass the PathPR filter 450 to eliminate the group delay in effort to gain extra noise cancellation performance. Thus, in this regard, the PathPR filter 450 receives a signal FAST_ADAPTATION that correspond to a condition in which the driver's desire for the vehicle to increase in speed exceeds a predetermined threshold. Thus, the signal FAST_ADAPTATION may correspond, but not limited to, the position of the accelerator pedal, the rate of change of the accelerometer pedal position, the rate of change of wheel RPM, the rate of change of engine RPM, the rate of change of global positioning system (GPS) determined vehicle location, the rate of change of measured engine order harmonic frequency, a rate of change of engine torque, a rate of change of speed, and jerk.

Further, to attain increased fuel efficiency, cylinder deactivation or rapidly changing, dynamic skip fire methods of augmenting engine cylinder firing sequences can instantaneously change the engine orders that are created and radiated at high amplitude (i.e., which engine orders sound the loudest). In addition, a gear shift, which can be automatically triggered by vehicle systems, or can be manually triggered in a traditional way by depressing the clutch pedal, manually moving a lever and re-engaging the clutch, or by activation of flappy paddle style shifters (or any other manual mechanisms) can also trigger a sudden, discontinuity in engine order frequencies and amplitudes. In these dynamic engine operating scenarios, also termed "fast adaptation events" may be transmitted on the signal FAST_ADAPTATION, it is advisable to quickly bypass the PathPR filter 450 to eliminate the group delay in effort to gain extra noise cancellation performance, especially at the onset of the dynamic event. Thus, in this regard, the PathPR filter 450 receives the signal FAST_ADAPTATION that corresponds to a condition in which the engine's operating conditions have changed such that the engine order frequencies or amplitudes being radiated differ by a predetermined threshold. Thus, the signal FAST_ADAPTATION may correspond, but not limited to receiving a signal from via the powertrain controller area network (CAN) bus or other vehicle data bus indicating that the vehicle has enter a cylinder deactivation mode, where the deactivated cylinders have no fuel injected, and the intake and exhaust valves remain closed to avoid pumping losses. A fast adaptation event required event may include receiving a signal that a transmission gear shift has happened from a bus signal, a transition in engine RPM greater than a threshold, from a vibratory or acoustically measured shift in engine order frequency, or a measured shift in multiple engine order frequencies. A fast adaptation event may include receiving a message via a CAN or other vehicle bus that the engine is operating in a dynamic skip fire mode, where the individual cylinders that are deactivated are determined in a short notice, and possibly in a method or order that appears somewhat random. Note that dynamic skipfire and cylinder deactivation status are straight forward to detect, so they could also be measured vibrationally or acoustically or with other sensors in order to generate the fast adaptation required event signal that triggers the PathPR controller 452 to change the PathPR filter 450 to a predetermined matrix (e.g., an identity matrix) or in any other functionally equivalent way to bypass the filtering provided by filter 450 and to eliminate group delay to gain extra noise cancellation performance.

Further, the signal FAST ADAPTATION may correspond to aspects of an RNC system operation. In these vehicle operating situations, it is advisable to quickly bypass the PathPR filter 450 in the RNC system to eliminate the group delay in effort to gain extra noise cancellation performance, especially at the onset of the changed vehicle operating conditions. These vehicle operating conditions include driving the vehicle from one pavement type to another pavement type, accelerating a vehicle from 0 mph (or another low speed) to 30 mph rapidly, or other rapid acceleration situations. In addition, decelerating a vehicle from high speed, for example 60 mph or higher, where wind noise has a large impact on the soundscape in the vehicle cabin to lower speed such as 40 mph also can trigger the FAST_ADAPTATION signal. For example, when a vehicle is operating on a first road surface (i.e., paved road) and the road surface changes to a second surface (i.e., gravel), the RNC system must adapt. During the initial adaptation time, the level of in-cabin noise at locations of the listeners' ears will be higher than if the system were fully adapted. Note that pavement types can be determined based on data from navigation systems (which can often identify dirt roads and gravel roads as a separate type from paved roads). Pavement types can also be determined from analysis of acceleration or microphone sensor data. For a smooth road type, the accelerometer signal may be stationary with low levels, i.e., in the range of less than 0.2 g, and a broadband frequency content of approximately 30-400 Hz. For a cobblestone road type, the accelerometer signal characteristics may be stationary with high levels of acceleration, i.e., in the range greater than 1 g, in the broadband frequency range of 30-400 Hz with especially high levels at the lowest frequencies in this range. For a rough road type, the accelerometer signal may be stationary with a medium acceleration level (0.3-0.9 g) in the frequency range of 30-400 Hz. For a grooved concrete road type, the accelerometer signal may exhibit medium levels (0.3-0.9 g) and high tonal frequency content at approximately 150 Hz. For a cracked road type, the accelerometer signal is non-stationary, impulsive and has high levels (>1 g) over the broadband frequency range from 30-400 Hz. It should be noted both sensor types are not necessary to determine road type. A transition between road types can be detected by a change in the statistics of the sensor types listed above. Note that the pavement types do not actually need to be identified in order to trigger a FAST_ADAPTATION signal. The processor 414 only need to detect that the average or peak levels in a frequency band have suddenly changed, and a FAST_ADAPTATION signal is triggered.

The PathPR controller 452 monitors such signals to determine when the vehicle is exhibiting rapid acceleration event or the fast adaptation event such as, for example, a wide-open throttle (WOT) state. In the event the vehicle is exhibiting a WOT state, the PathPR controller 452 controls the PathPR filter 450 to the predetermined matrix to bypass the filter 450 and to eliminate group delay to gain extra noise cancellation performance. A WOT can be detected by the PathPR controller 452 by comparing an accelerometer pedal position to its maximum position (i.e., the pedal fully depressed to the floor) which is 100% pedal position. A WOT is defined as 100% pedal position. However, other predetermined thresholds that indicate a rapid acceleration event can be stored, and these include but are not limited to the pedal being depressed to 67% of maximum, or the pedal being depressed to 83% of maximum. Similar thresholds indicating a rapid acceleration event are possible for a rate of change for RPM. For example, a fast vehicle accelerating near its maximum rate may have an RPM change above 1000 RPM per second. Similarly, the wheel RPM may be 800 RPM at 60 mph, so a change of wheel RPM of 100 RPM per second could be a threshold to indicate a rapid acceleration event. Engine torque may be a preferred indicator for a rapid acceleration event because torque is related to the creation of vehicle acceleration. A typical sedan may have a peak torque of 250 lb-ft at a particular RPM, however a maximum torque depends on the RPM, so a predetermined threshold that is indicative of a rapid acceleration event may be 70% of the maximum torque for that RPM, which may be 175 ft-lbs. Other predetermined thresholds are possible.

Other functionally equivalent ways to bypass the filter 450 is to replace the filter 450 with any filter type that has near zero group delay in any region of frequencies where the system 400 exhibits desirable noise cancellation. This could include replacing filter 450 with all pass filters, or with filters incurring only magnitude change and no phase change. It could also include replacing predetermined filter 450 with a predetermined filter that has only 55%, or only 35% the group delay of predetermined filter 450, as either of these would substantially increase the adaptation speed of the noise cancellation system 400. In an embodiment, filter 450 is simply bypassed or is a unity gain filter which effectively bypasses it. In an embodiment filter 450 is a non-unity gain filter that is not frequency dependent, which adds no additional group delay. In an embodiment with equal numbers of physical and remote microphones, a diagonal, identity matrix is selected. In an embodiment with unequal numbers of physical and remote microphones, a sparse matrix having only a small number of "1" values equal to the number of remote microphones is selected. In an embodiment, filter 450 is a matrix that is frequency dependent and may include all real numbers, so as to incur no additional group delay. In an embodiment, other ways to save latency in these dynamic scenarios could also be implemented. For example, selecting only speakers that have the lowest group delay (or latency) physical or remote secondary paths could save on system latency, resulting in the physical microphone 408 signal and hence the remote microphone 412 signal entering the LMS controller 428 sooner, which will expedite the adaptation and result in improved noise cancellation at the beginning of these fast adaptation or rapid acceleration events. Similarly, selecting only microphones that have the lowest group delay will also expedite adaptation and result in improved noise cancellation. For example, an eight-cylinder engine may radiate $2^{nd}$, $4^{th}$ and $8^{th}$ engine orders with high amplitude, but in cylinder deactivation mode in six-cylinder mode, the engine may radiate different engine orders with high amplitude, such as $3^{rd}$, $6^{th}$ and $9^{th}$ engine order. This change can be detected vibrationally or acoustically and analyzed by the processor 414 to trigger a fast adaptation condition.

Figure 6:
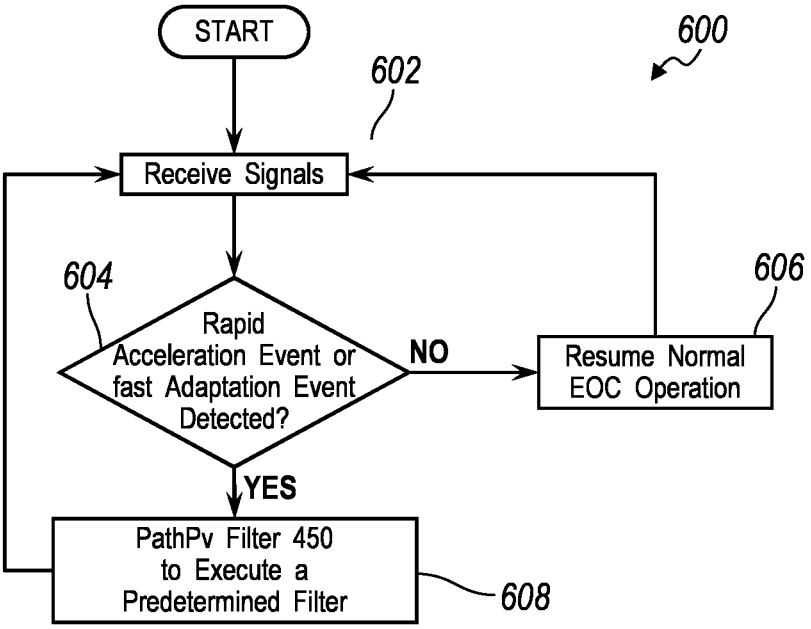
FIG. 6 is a flowchart depicting a method for enabling a fast-adapting mode for a noise cancellation system such as a remote microphone engine or road noise cancellation system in accordance with one or more embodiments of the present disclosure.

FIG. 6 is a flowchart depicting a method 600 for enabling a fast-adapting mode for a noise cancellation system such as a remote microphone engine or road noise cancellation system in accordance with one or more embodiments of the present disclosure. Various steps of the disclosed method may be carried out by the PathPR controller 452 either alone, or in combination with other components of the RM ANC system 406 which may be applicable to EOC or RNC.

At step 602, the PathPR controller 452 receives the one or more signals (e.g., the fast adaptation (FA) signal(s)) from various other vehicle systems (i.e., the external processor(s) 414) that may be indicative of the vehicle exhibiting a rapid acceleration event or a fast-adapting event. These signals can include engine RPM, wheel RPM, Shaft RPM, instantaneous accelerator pedal position, rate of change of accelerator pedal position, engine torque, rate of change of engine torque, engine order frequency for frequencies, rate of change of engine order frequencies, gear shift signals, engine cylinder deactivation signals, dynamic skip-fire signals, the rate of change of GPS determined vehicle location. In addition, the one or more signals may be indicative of (i) an engine amplitude, (ii) a cylinder deactivation mode, (iii) a transmission gear shift, (iv) measured shift in multiple order frequencies, (v) engine is operating in a dynamic skip fire mode. Similarly, the one or more signals may be indicative of (i) a vehicle being driven from one pavement type to another pavement type, (ii) the vehicle being driven from a first speed (e.g., 0 mph) to a second speed (e.g., 30 mph) within a predetermined time frame, (iii) the vehicle exhibiting a deceleration event from a first speed to a second speed with a predetermined time frame.

At step 604, the PathPR controller 452 compares the one or more of the signals received in step 602 to predetermined threshold values. If any one or more of the signals or statistics derived from the signals exceed the predetermined thresholds, then the method 600 proceeds to step 608. If not, then the method 600 proceed to step 606. Similarly, the Path PR controller 452 monitors data as also received on signal(s) that do not require a comparison to a threshold but may be indicative of the vehicle being in a fast adaptation event to ascertain if it is necessary to bypass the PathPR filter 450 (e.g., set the PathPR filter 450 to a predetermined matrix, such as for example, the unity matrix). If any of such data indicate that the vehicle if exhibiting the fast adaptation event, then the method 600 moves to operation 608. If not, then the method 600 moves to operation 606.

At step 608, the PathPR controller 452 determines that the vehicle is exhibiting a rapid acceleration event or fast adapting event and controls the PathPR filter 450 to bypass the filter 450 to eliminate group delay in order to gain extra noise cancellation performance.

At step 606, the system 406 resumes normal EOC operation. In one example, the PathPR controller 452 may continue to control the PathPR filter 450 to be bypassed for a period of time (i.e., the PathPR filter 450 is set to the predetermined matrix) until the rapid acceleration event or fast adapting event is detected to be removed. Upon expiration of the rapid acceleration event or the fast-adapting event, the PathPR controller 452 controls the PathPR filter 450 to reload original coefficients into the PathPR filter 450.

Although the ANC system as disclosed herein is described with reference to a vehicle, the techniques described herein are applicable to non-vehicle applications. For example, a room may have fixed seats which define a listening position at which to quiet a disturbing sound using reference sensors, error sensors, remote and virtual microphones, loudspeakers and an LMS adaptive system. Note that the disturbance noise to be cancelled is likely of a different type, such as HVAC noise, or noise from adjacent rooms or spaces that may change in character very quickly. For the period of time immediately after an abrupt change, the PathPR filter 450 can be set to a predetermined matrix (e.g., an identity matrix) to expedite adaptation to enhance the noise cancellation experience.

Although FIG. 4 illustrates an LMS-based adaptive filter controller 428, respectively, other methods and devices to adapt or create an optimal controllable W-filters 426 is possible. For example, in one or more embodiments, neural networks may be employed to create and optimize a W-filter in place of the LMS adaptive filter controllers. In other embodiments, machine learning or artificial intelligence may be used to create an optimal W-filter in place of the LMS adaptive filter controller.

Any one or more of the controllers or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof.

For example, the steps recited in any method or process claims may be executed in any order and are not limited to the specific order presented in the claims. Equations may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Further, functionally equivalent processing steps can be undertaken in either the time or frequency domain. Accordingly, though not explicitly stated for each signal processing block in the figures, the signal processing may occur in either the time domain, the frequency domain, or a combination thereof. Moreover, though various processing steps are explained in the typical terms of digital signal processing, equivalent steps may be performed using analog signal processing without departing from the scope of the present disclosure Benefits, advantages and solutions to problems have been described above with regard to particular embodiments. However, any benefit, advantage, solution to problems or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. An active noise cancellation (ANC) system comprising:

at least one loudspeaker to project anti-noise sound within a cabin of a vehicle in response to receiving an anti-noise signal;

at least one microphone to provide an error signal indicative of noise and the anti-noise sound within the cabin;

a first filter programmed to modify a transfer function between the at least one microphone and at least one remote microphone location to generate an estimated remote microphone error signal based at least on the error signal;

a first controllable filter programmed to generate the anti-noise signal based on the estimated remote microphone error signal; and at least one controller programmed to:

receive a first signal indicative of the vehicle exhibiting a fast-adapting event, and control the first filter to execute a predetermined filter based on the first signal to reduce a group delay associated with the first filter.

2. The ANC system of claim 1, wherein:

the first signal includes one of a wheel rotations per minute (RPM), a rate of change (ROC) of the wheel RPM, an engine RPM, a ROC of engine RPM, a shaft RPM, a ROC of the shaft RPM, a ROC of global position satellite (GPS) coordinates, a ROC of engine order harmonic frequencies, an engine torque, and a ROC of engine torque;

the at least one controller is further programmed to compare one of the wheel RPM, the ROC of the wheel RPM, the engine RPM, the ROC of the engine RPM, the shaft RPM, the ROC of the shaft RPM, the ROC of the GPS coordinates, the ROC of the engine order harmonic frequencies, the engine torque, and the ROC of the engine torque to a predetermined value; and the at least one controller is further programmed to control the first filter to execute the predetermined filter in response to one of the wheel rotations RPM, the ROC of the wheel RPM, the engine RPM, the ROC of the engine RPM, the shaft RPM, the ROC of the shaft RPM, the ROC of the GPS coordinates, the ROC of the engine order harmonic frequencies, the engine torque, and the ROC of the engine torque exceeding the predetermined value.

3. The ANC system of claim 1, wherein:

the first signal includes information corresponding to one of an engine cylinder mode, a transmission gear shift, and an engine operating mode;

the at least one controller is further programmed to determine one of (i) the engine cylinder mode exhibiting a cylinder deactivation mode, (ii) the transmission gear shift exhibiting a gear shift change; and (iii) the engine operating mode exhibiting a dynamic skip fire mode; and the at least one controller is further programmed to execute the predetermined filter in response to one of (i) the engine cylinder mode exhibiting the cylinder deactivation mode, (ii) the transmission gear shift exhibiting the gear shift change, and (iii) the engine operating mode exhibiting the dynamic skip fire mode.

4. The ANC system of claim 3, wherein the cylinder deactivation mode corresponds to deactivated cylinders that have no fuel being injected and the dynamic skip fire mode corresponding to an individual engine cylinder that is deactivated.

5. The ANC system of claim 1, wherein:

the first signal includes information corresponding to one of (i) driving the vehicle from a first pavement type to a second pavement type, (ii) accelerating the vehicle from a first speed to a second speed within a first predetermined time interval, and (iii) deaccelerating the vehicle from a third speed to a fourth speed within a second predetermined time interval; and the at least one controller is further programmed to execute the predetermined filter in response to the one of (i) driving the vehicle from the first pavement type to the second pavement type, (ii) the vehicle accelerating from the first speed to the second speed within the first predetermined time interval, and (iii) decelerating the vehicle from the third speed to the fourth speed within the second predetermined time interval.

6. The ANC system of claim 1, wherein the at least one controller is further programmed to control the first filter to execute the predetermined filter based on the first signal to reduce the group delay associated with the first filter while performing one of engine order cancellation (EOC) and road noise cancellation (RNC).

7. The ANC system of claim 1, wherein the at least one controller is further programmed to bypass the first filter from the ANC system by controlling the first filter to execute the predetermined filter.

8. The ANC system of claim 1, wherein the predetermined filter is an identity matrix.

9. A method for performing active noise cancellation (ANC) comprising:

transmitting anti-noise sound within a cabin of a vehicle in response to receiving an anti-noise signal at a loudspeaker;

providing an error signal indicative of noise and the anti-noise sound within the cabin;

modifying, via a first filter, to generate an estimated remote microphone error signal based at least on the error signal;

generating the anti-noise signal via a first controllable filter based on the estimated remote microphone error signal;

receiving a first signal indicative of the vehicle exhibiting a fast-adapting event, and bypassing the first filter from an ANC system to reduce a group delay associated with the first filter based on the first signal.

10. The method of claim 9, wherein:

the first signal includes one of a wheel rotations per minute (RPM), a rate of change (ROC) of the wheel revolutions per minute (RPM), an engine RPM, a ROC of engine RPM, a shaft RPM, a ROC of the shaft RPM, a ROC of global position satellite (GPS) coordinates, a ROC of engine order harmonic frequencies, an engine torque, and a ROC of engine torque;

the method further including:

comparing one of the wheel RPM, the ROC of the wheel RPM, the engine RPM, the ROC of the engine RPM, the shaft RPM, the ROC of the shaft RPM, the ROC of the GPS coordinates, the ROC of the engine order harmonic frequencies, the engine torque, and the ROC of the engine torque to a predetermined value; and bypassing the first filter from the ANC system in response to one of the wheel rotations RPM, the ROC of the wheel RPM, the engine RPM, the ROC of the engine RPM, the shaft RPM, the ROC of the shaft RPM, the ROC of the GPS coordinates, the ROC of the engine order harmonic frequencies, the engine torque, and the ROC of the engine torque exceeding the predetermined value.

11. The method of claim 9, wherein:

the first signal includes information corresponding to one of an engine cylinder mode, a transmission gear shift, and an engine operating mode;

determining whether one of (i) the engine cylinder mode is exhibiting a cylinder deactivation mode, (ii) the transmission gear shift is exhibiting a gear shift change; and (iii) the engine is operating in a dynamic skip fire mode; and bypassing the first filter from the ANC system in response to one of (i) the engine cylinder mode exhibiting the cylinder deactivation mode, (ii) the transmission gear shift exhibiting the gear shift change, and (iii) the engine operating in the dynamic skip fire mode.

12. The method of claim 11, wherein the cylinder deactivation mode corresponds to deactivated cylinders that have no fuel being injected and the dynamic skip fire mode corresponding to an individual engine cylinder that is deactivated.

13. The method of claim 9, wherein:

the first signal includes information corresponding to one of (i) driving the vehicle from a first pavement type to a second pavement type, (ii) accelerating the vehicle from a first speed to a second speed within a first predetermined time interval, and (iii) deaccelerating the vehicle from a third speed to a fourth speed within a second predetermined time interval; and bypassing the first filter from the ANC system in response to one of (i) the vehicle being driven from the first pavement type to the second pavement type, (ii) the vehicle accelerating from the first speed to the second speed within the first predetermined time interval, and (iii) the vehicle decelerating from the third speed to the fourth speed within the second predetermined time interval.

14. The method of claim 9, wherein bypassing the first filter is performed while performing one of engine order cancellation (EOC) and road noise cancellation (RNC).

15. The method of claim 9, wherein bypassing the first filter includes controlling the first filter to execute a predetermined filter based on the first signal.

16. The method of claim 15, wherein the predetermined filter is an identity matrix.

17. A computer-program product embodied in a non-transitory computer readable medium that is programmed for performing active noise cancellation (ANC), the computer-program product comprising instructions for:

transmitting anti-noise sound within a cabin of a vehicle in response to receiving an anti-noise signal at a loudspeaker;

providing an error signal indicative of noise and the anti-noise sound within the cabin;

modifying, via a first filter, to generate an estimated remote microphone error signal based at least on the error signal;

generating the anti-noise signal via a first controllable filter based on the estimated remote microphone error signal;

receiving a first signal indicative of the vehicle exhibiting a fast-adapting event, and controlling the first filter to execute a predetermined filter based on the first signal to reduce a group delay associated with the first filter.

18. The computer program product of claim 17 further comprising instructions for controlling the first filter to execute the predetermined filter based on the first signal to reduce the group delay associated with the first filter while performing one of engine order cancellation (EOC) and road noise cancellation (RNC).

19. The computer program product of claim 17 further comprising instructions for bypassing the first filter by controlling the first filter to execute the predetermined filter.

20. The computer program product of claim 17, wherein the predetermined filter is an identity matrix.

* * * * *